US009371696B2

(12) United States Patent
Oppelaar

(10) Patent No.: US 9,371,696 B2
(45) Date of Patent: Jun. 21, 2016

(54) APPARATUS AND METHOD FOR DRILLING DEVIATED WELLBORES THAT UTILIZES AN INTERNALLY TILTED DRIVE SHAFT IN A DRILLING ASSEMBLY

(71) Applicant: Hans Oppelaar, Bergen (DE)

(72) Inventor: Hans Oppelaar, Bergen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 628 days.

(21) Appl. No.: 13/729,827

(22) Filed: Dec. 28, 2012

(65) Prior Publication Data

US 2014/0182941 A1 Jul. 3, 2014

(51) Int. Cl.
*E21B 7/04* (2006.01)
*E21B 7/06* (2006.01)

(52) U.S. Cl.
CPC ..... *E21B 7/067* (2013.01)

(58) Field of Classification Search
CPC ..... E21B 7/04; E21B 7/06; E21B 7/062; E21B 7/067
See application file for complete search history.

(56) References Cited

U.S. PATENT DOCUMENTS

| | | | | |
|---|---|---|---|---|
| 3,667,556 | A | 6/1972 | Henderson | |
| 4,732,223 | A | 3/1988 | Schoeffler et al. | |
| 4,895,214 | A | 1/1990 | Schoeffler | |
| 5,529,133 | A | 6/1996 | Eddison | |
| 5,617,926 | A | 4/1997 | Eddison et al. | |
| 6,092,610 | A | 7/2000 | Kosmala et al. | |
| 6,109,372 | A * | 8/2000 | Dorel et al. | 175/61 |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,439,321 | B1 | 8/2002 | Gillis et al. | |
| 6,837,315 | B2 | 1/2005 | Pisoni et al. | |
| 7,287,604 | B2 * | 10/2007 | Aronstam et al. | 175/61 |
| 7,360,609 | B1 | 4/2008 | Falgout, Sr. | |
| 7,445,059 | B1 | 11/2008 | Falgout, Sr. | |
| 7,866,415 | B2 * | 1/2011 | Peters | 175/76 |
| 2003/0121702 | A1 * | 7/2003 | Downton et al. | 175/76 |
| 2004/0262043 | A1 * | 12/2004 | Schuaf | 175/57 |
| 2009/0032302 | A1 * | 2/2009 | Downton et al. | 175/38 |
| 2009/0272579 | A1 * | 11/2009 | Sihler et al. | 175/45 |
| 2010/0025115 | A1 * | 2/2010 | Kotsonis et al. | 175/61 |
| 2012/0018225 | A1 * | 1/2012 | Peter et al. | 175/61 |

FOREIGN PATENT DOCUMENTS

| | | | |
|---|---|---|---|
| EP | 1106777 | A1 | 6/2001 |
| EP | 1258593 | A2 | 11/2002 |
| EP | 1857631 | A1 | 11/2007 |

* cited by examiner

*Primary Examiner* — Benjamin Fiorello
(74) *Attorney, Agent, or Firm* — Cantor Colburn LLP

(57) ABSTRACT

In one aspect, an apparatus for use in a wellbore is disclosed that in one embodiment includes a tool having a rotating member adapted to be coupled to a drill bit and a steering device that includes a force application device that tilts the drive member and a rotational drive that maintains the force application device geostationary.

24 Claims, 7 Drawing Sheets

APPARATUS AND METHOD FOR DRILLING DEVIATED WELLBORES THAT UTILIZES AN INTERNALLY TILTED DRIVE SHAFT IN A DRILLING ASSEMBLY

BACKGROUND OF THE DISCLOSURE

1. Field of the Disclosure

The present disclosure relates to drilling systems that utilize a steering device placed inside a drilling assembly to drill deviated wellbores.

2. Description of the Related Art

Many wells or wellbores for recovering hydrocarbons (oil and gas) from subsurface formations are deviated or horizontal wells. Drilling systems employed to drill such wellbores include a drill string that has a drilling assembly with a drill bit at its bottom end. The drill string is conveyed from a surface rig into the wellbore by a tubular or tubing made by joining drill pipe sections. A steering device is typically provided to tilt the drill bit along a desired direction. Some steering units include devices that apply force on the inside wall of the wellbore. Other steering units are placed inside the drilling assembly to tilt the drilling assembly.

The disclosure herein provides drilling apparatus and methods for drilling deviated wellbores that utilize a steering device or unit inside the drilling assembly to control the tilt and drilling direction of the drilling assembly.

SUMMARY

In one aspect, an apparatus for use in a wellbore is disclosed that in one embodiment includes: a tool having a rotating member adapted to be coupled to a drill bit and a steering device that includes a force application device that tilts the rotating member and a rotational drive that maintains the force application device geostationary.

In another aspect, a method of drilling a wellbore is disclosed that in one embodiment includes: conveying a drilling assembly in the wellbore that includes a drive shaft coupled to a drill bit, a steering device that includes a force application device around the drive shaft to apply force on the drive shaft to tilt the drive shaft; rotating the drilling assembly to rotate the drive shaft to drill the wellbore; maintaining the force application device geostationary; applying force radially on the drive shaft by the force application device to tilt the drive shaft by a selected angle along a selected direction to drill the wellbore along the selected direction.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description of the exemplary embodiment, taken in conjunction with the accompanying drawings, in which like elements have been given like numerals and wherein.

DETAILED DESCRIPTION OF THE DISCLOSURE

Figure 1:
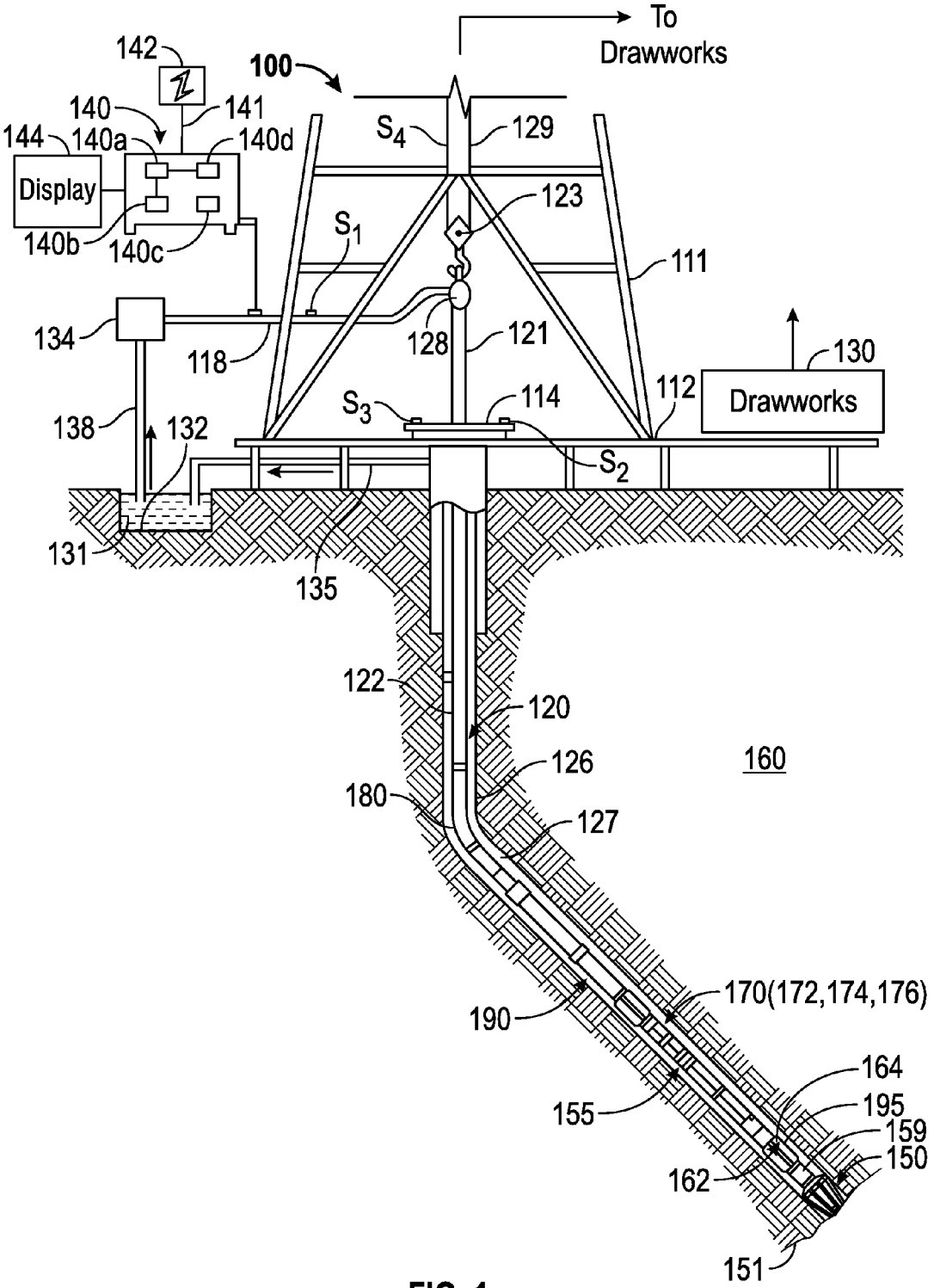
FIG. 1 is a schematic diagram of an exemplary drilling system that includes a drill string having a drilling assembly attached to its bottom end that includes a steering unit according to one embodiment of the disclosure.

FIG. 1 shows an exemplary drilling system 100 that includes a steering device 195 according to one embodiment of the disclosure. The drilling system 100 is shown to include a drill string 120 that comprises a drilling assembly or bottomhole assembly (BHA) 190 attached to a bottom end of a drilling tubular (such as drill pipe) 122 configured to drill a wellbore 126 in a formation 160. The drilling system 100 is further shown to include a conventional derrick 111 erected on a platform 112 that supports a rotary table 114 rotated by a prime mover, such as an electric motor (not shown), to rotate the drilling tubular 122 at a desired rotational speed. A top drive (not shown) may also be utilized to rotate the drill string 120. The drilling tubular 122 is typically made up of jointed metallic pipe sections and extends downward from the rotary table 114 into the wellbore 126. A drill bit 150 attached to the end of the drilling assembly 190 disintegrates the geological formations when it is rotated to drill the wellbore 126. The drill string 120 is coupled to a drawworks 130 via a Kelly joint 121, swivel 128 and line 129 through a pulley 123. During drilling of the wellbore 126, draw works 130 controls the weight on bit (WOB) which affects the rate of penetration.

During drilling operations, a suitable drilling fluid or mud 131 from a source or mud pit 132 is circulated under pressure through the drill string 120 by a mud pump 134. The drilling fluid 131 passes from the mud pump 134 into the drilling tubular 122 via a desurger (not shown) and a fluid line 118. The drilling fluid 131 discharges at the wellbore bottom 151 through an opening in the drill bit 150. The drilling fluid 131 circulates uphole through an annular space 127 between the drill string 120 and the wellbore 126 and returns to the mud pit 132 via a return line 135. A sensor $S_1$ in the line 138 provides information about the fluid flow rate. A surface torque sensor $S_2$ and a sensor $S_3$ associated with the drill string 120 respectively provide information about the torque and the rotational speed of the drill string 120 and thus the BHA 190. Additionally, one or more sensors (collectively referred to as $S_4$) associated with line 129 may be utilized to provide information about the hook load of the drill string 120 and other desired drilling parameters relating to drilling of the wellbore 126.

The drilling system 100 may further include a surface control unit 140 configured to provide information relating to the drilling operations and for controlling certain desired drilling operations. In one aspect, the surface control unit 140 may be a computer-based system that includes one or more processors (such as microprocessors) 140*a*, one or more data storage devices (such as solid state-memory, hard drives, tape drives, etc.) 140*b*, display units and other interface circuitry 140*c*. Computer programs and models 140*d* for use by the processors 140*a* in the control unit 140 may be stored in the data storage devices 140*b*, including, but not limited to: a solid-state memory, hard disc and tape. The surface control unit 140 may communicate data to a display 144 for viewing by an operator or user. The surface control unit 140 also may interact with one or more remote control units 142 via any suitable data communication link 141, such as the Ethernet and the Internet. In one aspect, signals from various devices in the drilling assembly 190 are received by the surface control unit 140 via a communication link, such as drilling fluid, electrical conductors, fiber optic links, wireless links, etc. The surface control unit 140 processes the received data and signals according to programs and models 140*d* provided to the surface control unit and provides information about drilling parameters such as weight-on-bit (WOB), rotational speed of the drilling assembly, fluid flow rate, hook load, etc. and formation parameters such as resistivity, acoustic properties, porosity, permeability, etc. This information, alone or along with information from other sources, may be utilized by the control unit 140 and/or a drilling operator at the surface to control one or more aspects of the drilling system 100, including drilling the wellbore along a desired profile (also referred to as "geosteering") utilizing the steering device 195.

Still referring to FIG. 1, the drilling assembly 190, in one aspect, may include a variety of sensors, referred to as measurement-while-drilling sensors, collectively designated herein by numeral 162, located at selected locations in the drilling assembly 190, to provide measurements relating to various drilling assembly operating parameters, including, but not limited to, bending moment, stress, vibration, stick-slip, tilt, inclination and azimuth. Accelerometers, magnetometers and gyroscopic devices (collectively designated by numeral 164) may be utilized to determine inclination, azimuth and tool face. The drilling assembly 190 also includes a number of logging-while-drilling tools, collectively referred to by numeral 155, for estimating various properties of the formation 160. Such tools may include resistivity tools, acoustic tools, nuclear magnetic resonance (NMR) tools, gamma ray tools, nuclear logging tools, formation testing tools and other desired tools. Each such tool may process signals and data according to programmed instructions and provide information about certain properties of the formation. The drilling assembly further includes a downhole control unit 170 that contains a processor 172, storage devices 174 and programs and models 176 accessible to the processor for processing data from sensors 162, 164 and tools 155 and for communicating with the surface control unit 140. The downhole control unit 170 and/or surface control unit calculate parameters of interest from measurements obtained from the various sensors 162 and 164 and logging-while-drilling tools 155. The drilling assembly 190 further includes a telemetry unit 180 that establishes two-way data communication between the downhole controller and thus sensors 162 and 164 and tools 155 in the drilling assembly 190 and the surface control unit 140. Any suitable telemetry system may be used for the purpose of this disclosure, including, but not limited to: mud pulse telemetry, acoustic telemetry, electromagnetic telemetry and wired-pipe telemetry. In one aspect, the wired-pipe telemetry may include electric conductors or fiber optic cables run along individual drill pipe sections, wherein communication along pipe sections may be established by any suitable method, including, but not limited to: mechanical couplings, fiber optic couplings, electromagnetic signals, acoustic signals, radio frequency signals, or another wireless communication method. Various exemplary embodiments of steering devices 195 placed inside the drilling assembly to tilt a drive shaft coupled to the drill bit 150 to drill deviated wellbores are described in more detail in reference to FIGS. 2A, 2B, 2C through 6.

In general, the steering devices according to various embodiments described herein tilt a drive member that rotates with and an inside drilling assembly, wherein the steering devices are maintained geostationary relative to the tool axis. The steering devices control the drilling direction and the tilt of the drive member and thus the drill bit for drilling directional wellbores. The principle may be referred to as "point-the-bit" principle. In the various embodiments disclosed herein, steering devices are inside the drilling assembly body and may be integrated in the drilling assembly relatively close to the drill bit.

Figure 2A:
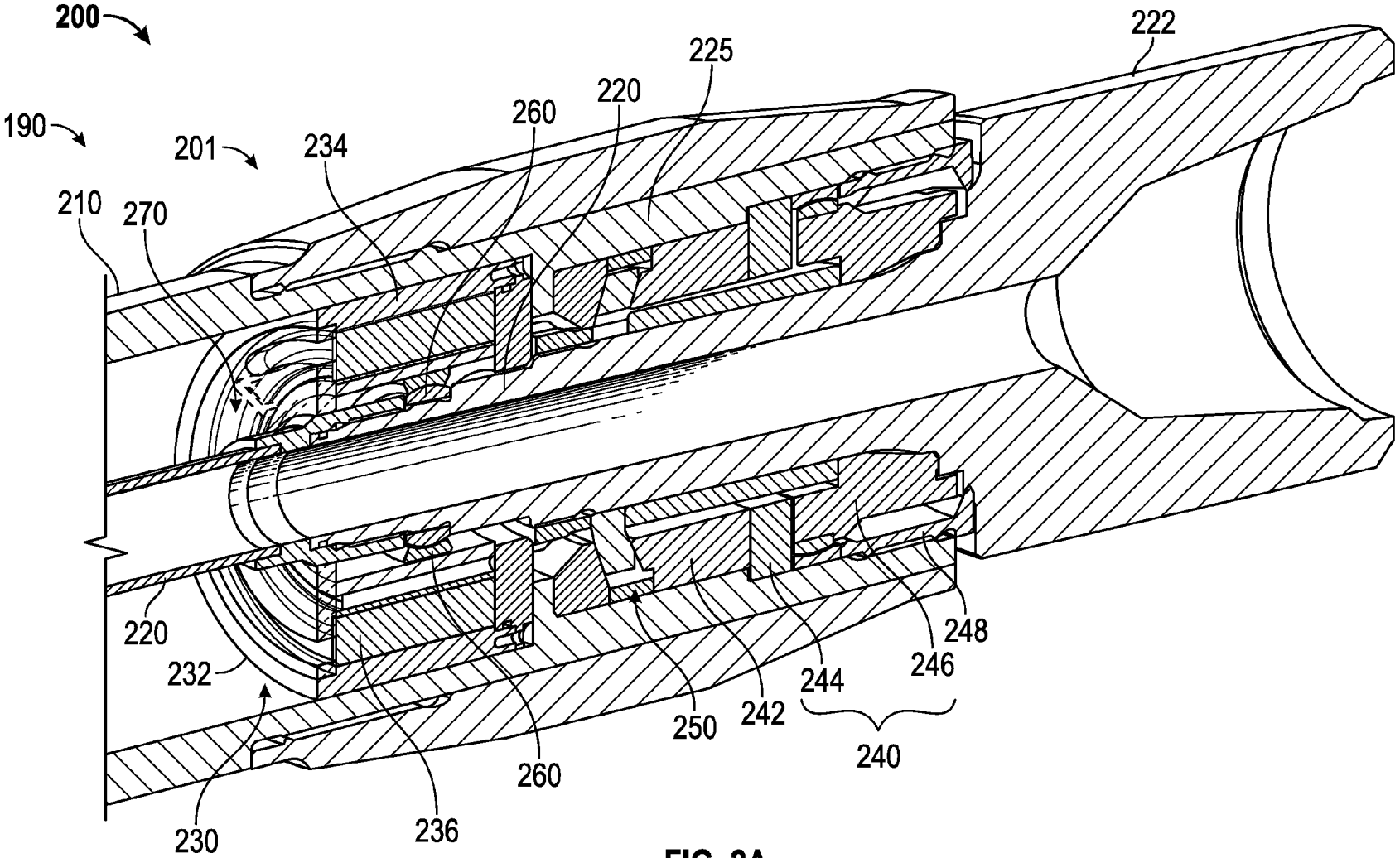
FIG. 2A shows an isometric view of an apparatus for tilting the drive shaft of a drilling assembly for drilling deviated wellbores, according to one embodiment of the disclosure.
Figure 2B:
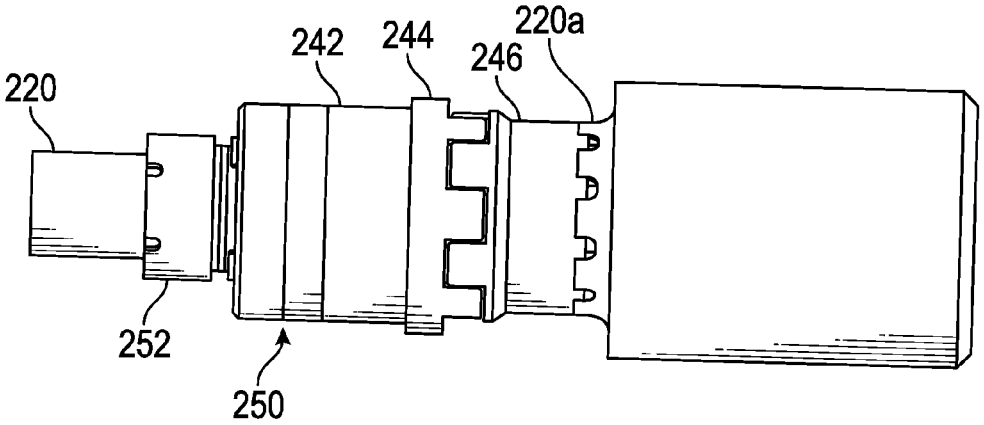
FIG. 2B shows an assembly used in the apparatus shown in FIG. 2A.
Figure 2C:
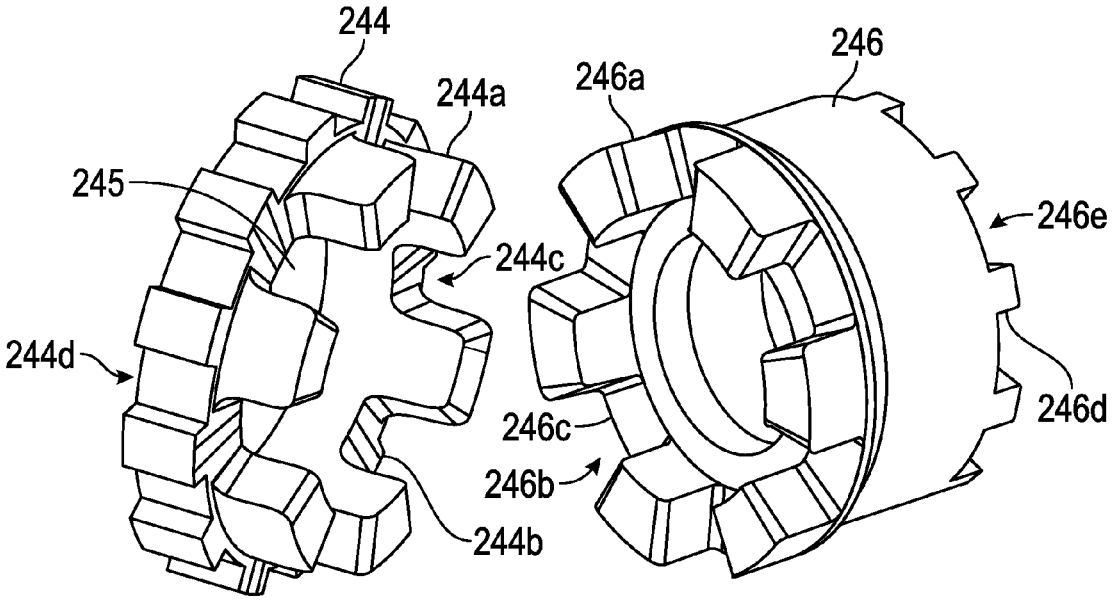
FIG. 2C shows a locking device for use in the apparatus of FIG. 2A for providing torque to the drive shaft.

FIG. 2A shows a section 201 of the drilling assembly 190 that includes a steering device 200 that may be used to drill deviated wellbores, according to one embodiment of the disclosure. Section 201 is shown to include a drive shaft 220 (drive member) disposed in a drill collar 210. The drive shaft 220 has a box end 222 that connects to a drill bit (not shown). The drive shaft 220 is connected to the drill collar 210 by connection elements collectively designated by numeral 225. The drill shaft 220 rotates with the drill collar when the drilling assembly 190 rotates. The connection 230 transmits torque, weight-on-bit and radial force but provides the drive shaft a tilt degree of freedom. A torque transmitter 240 is provided that in one embodiment may include interlocking members 244 and 246. In one configuration, the torque transmitter 240 is connected to the drive shaft 220 proximate to the box end 222*a* of the drive shaft 220. Axial bearings 242 and 250 provide axial support to the torque transmitter 240. An actuator or force application device 232-236 provides directional control and tilt of the drive shaft 220. FIG. 2B shows a subassembly 240A that includes the torque transmitter members 244 and 246 in a locked position around the drive shaft 220. The bearings 242 and 250 are coupled to the member 244 of the torque transmitter 240. In this configuration, the torque transmitter 240 rotates with the drive shaft 220. FIG. 2C show isometric views of the first and second torque members 244 and 246 of the torque device 240. Torque device member 244 is a circular member having a through opening 245. It includes a number of locking fingers 244*a* extending from a side 244*b* of the member 244 separated by spaces 244*c*. Spaces 244*d* are provided to accommodate fingers of torque member 246. Torque member 246 also is a circular member that includes fingers 246*a* a extending from one side 246*b* separated by spaces 246*c*. Fingers 244*a* of member 244 and fingers 246*a* of member 246 interlock as shown in FIG. 2B. Member 246 also may include fingers 246*d* extending from its other side 246*e*, which may be locked into the drive shaft 220 via spaces 220*a*. Any other suitable device may be used as the torque device in the steering device shown in FIG. 2.

Still referring to FIG. 2, the steering device 200 also includes a rotational drive 230 to maintain a force application device 260 geostationary relative to the axis of the drill collar 210. In one embodiment, the rotational drive 230 may include a housing 232 that may be rotated by any suitable rotational device, including, but not limited to, an electric motor, hydraulic motor, a motor driven by the drilling fluid. During drilling, the housing 232 rotates counter to the drive shaft 220 at the same rotational speed as that of the drive shaft 220 and rotates the force application device 260. Bearings 236 provide radial support to the housing 234. The counter rotation of the housing 234 maintains the force application device 260 geostationary. Any suitable device may be utilized to rotate the housing 232, including, but not limited to, an electric motor, an oil hydraulic device and a motor operated by the drilling fluid. During drilling, the drive shaft 220 rotates with the drill collar 210. The rotational drive 230 rotates the force application device 260 counter to the rotation of the drive shaft to maintain the force application device 260. A suitable force application mechanism, such as a rotary valve or an electrically-operated piston may be used to apply force on the force application device 260 at a selected location of the drive shaft 220 to tilt the drive shaft by a selected amount along a desired direction. To change the tilt, the force application mechanism alters the amount of the force. To alter the tilt direction, a positioning device 270 moves the force application mechanism to a new position around the drive shaft 220 to apply force on the drive shaft at a new location so as to cause the drive shaft to tilt toward the desired altered direction.

Figure 3:
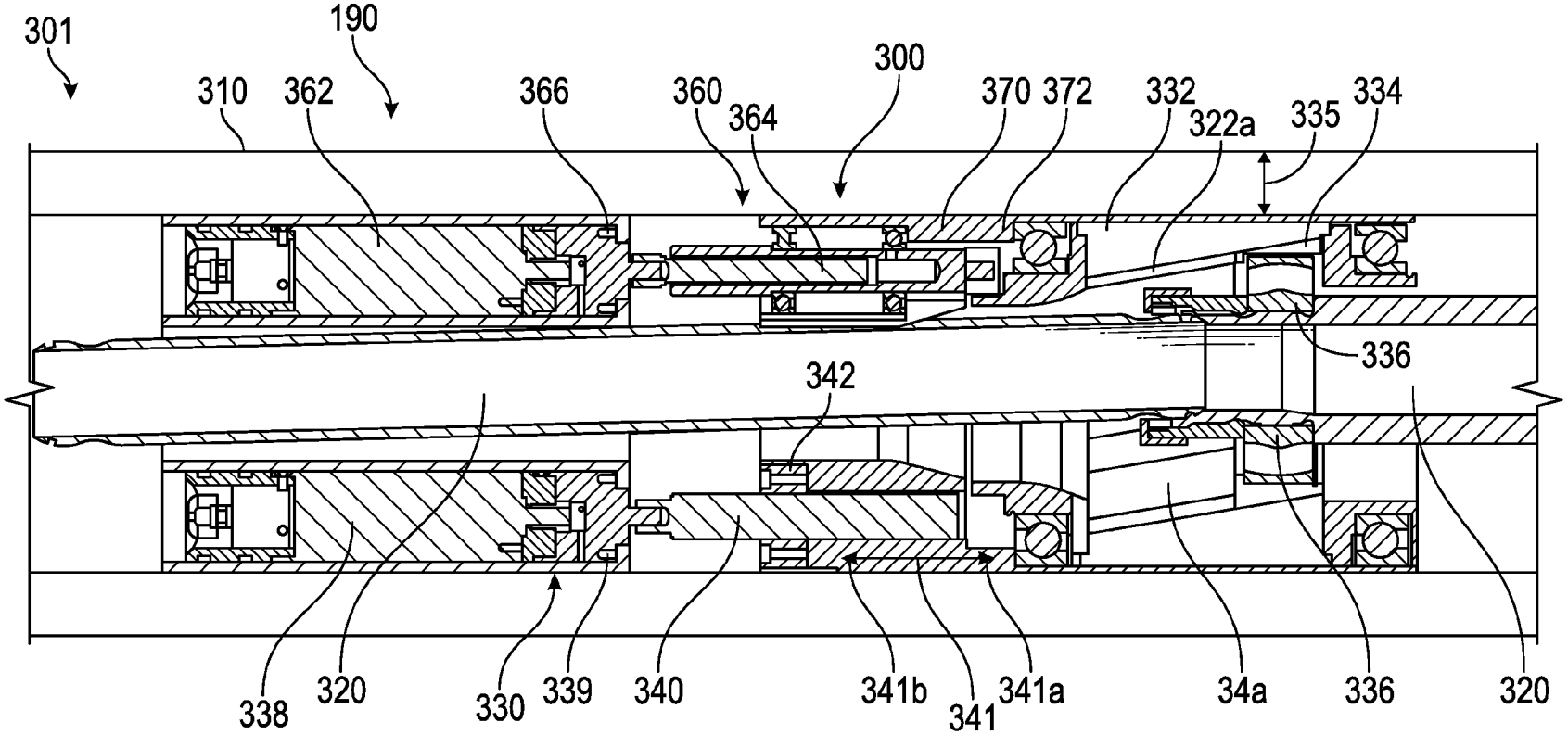
FIG. 3 shows an embodiment of another steering device that includes a sleeve that rotates in a direction counter to the drill shaft rotation direction maintain or control the drilling direction and a force application device that provides selected tilt to the drive shaft.

FIG. 3 shows a steering device 300 contained in a section 301 of a drilling assembly 190 for tilting a drive shaft 320 and for controlling the drilling direction, according to one embodiment of the disclosure. The drive shaft is connected to a drill collar 310 and rotates when the drilling assembly 190 and thus the drill collar 310 rotate. The steering device 300 includes an orienting sleeve 332 having an angled sliding surface 332*a* configured to move along axial direction 341. In one aspect, the sliding surface 332*a* may be a ratchet-like surface. A slider 334 or force member associated with the orienting sleeve 332 moves perpendicular to the axis of the drill collar 310 as shown by arrow 335. The slider 334 is a fixed member and moves radially relative to the center line of the tool as the orienting sleeve 332 moves axially. In the particular configuration of FIG. 1, when the orienting sleeve 332 moves right (in the direction 341*a*) the slider 334 moves upward and applies a radial force to the drive shaft 320 via a coupling member 336 to tilt the drive shaft 320 upward. In FIG. 3, the drive shaft 320 is shown tilted upward and the orienting sleeve is at its far right position, providing maximum tilt to the drive shaft 320. When the orienting sleeve moves left, the slider moves downward. The axial movement of the orienting sleeve controls the amount of the drill shaft tilt. The orienting sleeve 332 may be moved axially by any suitable linear drive 330, including, but not limited to, an oil hydraulic drive, an electric motor and a drive operated by the drilling fluid. In the particular configuration of FIG. 3, the drive 330 is shown to include an electric motor 338 that turns a screw 340 clockwise and counterclockwise via a coupling 339. The screw 340 in turn moves a nut 342 axially along the axial directions shown by arrow 341. For example, when motor 338 turns in a first direction (for example clockwise), the nut 342 moves forward along the direction 341*a* and when the motor 338 turns in a second direction (i.e., counter-clockwise), the nut 342 moves backward along the direction 341*b*. When the nut 342 moves forward, it moves the orienting sleeve 332 forward, which causes the slider 334 to move upward. As noted earlier, in FIG. 3, the orienting sleeve 332 is at the far right position and the slider 334 is at the uppermost position, providing maximum tilt.

Still referring to FIG. 3, the orienting sleeve 332 rotates against the rotation of the drive shaft 320 at the rotational speed of the drive shaft to maintain the orienting sleeve geostationary relative to the axis of the drill collar 310. The counter rotation of the orienting sleeve 332 may be induced by any suitable rotational drive, including, but not limited to, an electrical drive, hydraulic drive and a drive operated by the drilling fluid. The particular configuration of FIG. 3 shows an electric motor 362 to rotate the orienting sleeve 332. In one aspect, the motor 362 rotates an adjusting sleeve 370, which in turn rotates the orienting sleeve 332 via a coupling device 372. The motor 362 may be controlled by a controller, such as control unit 170 in the drilling assembly 190 and/or control unit 140 at the surface (FIG. 1) to rotate the adjusting sleeve 332 to maintain the sliding sleeve 332 geostationary relative to the axis of the drill collar 310. Thus, in the embodiment of FIG. 3, the tilt of the drive shaft 320 is provided by the orienting sleeve 332 and an angled guidance device 334. The orienting sleeve 332 also provides the tilt direction of the drive shaft and thus controls the drilling direction of the drilling assembly 190. The position of the slider 334 placed on the drive shaft 320 is varied to control the amount of the tilt or the angle of the drive shaft 320.

Figure 4:
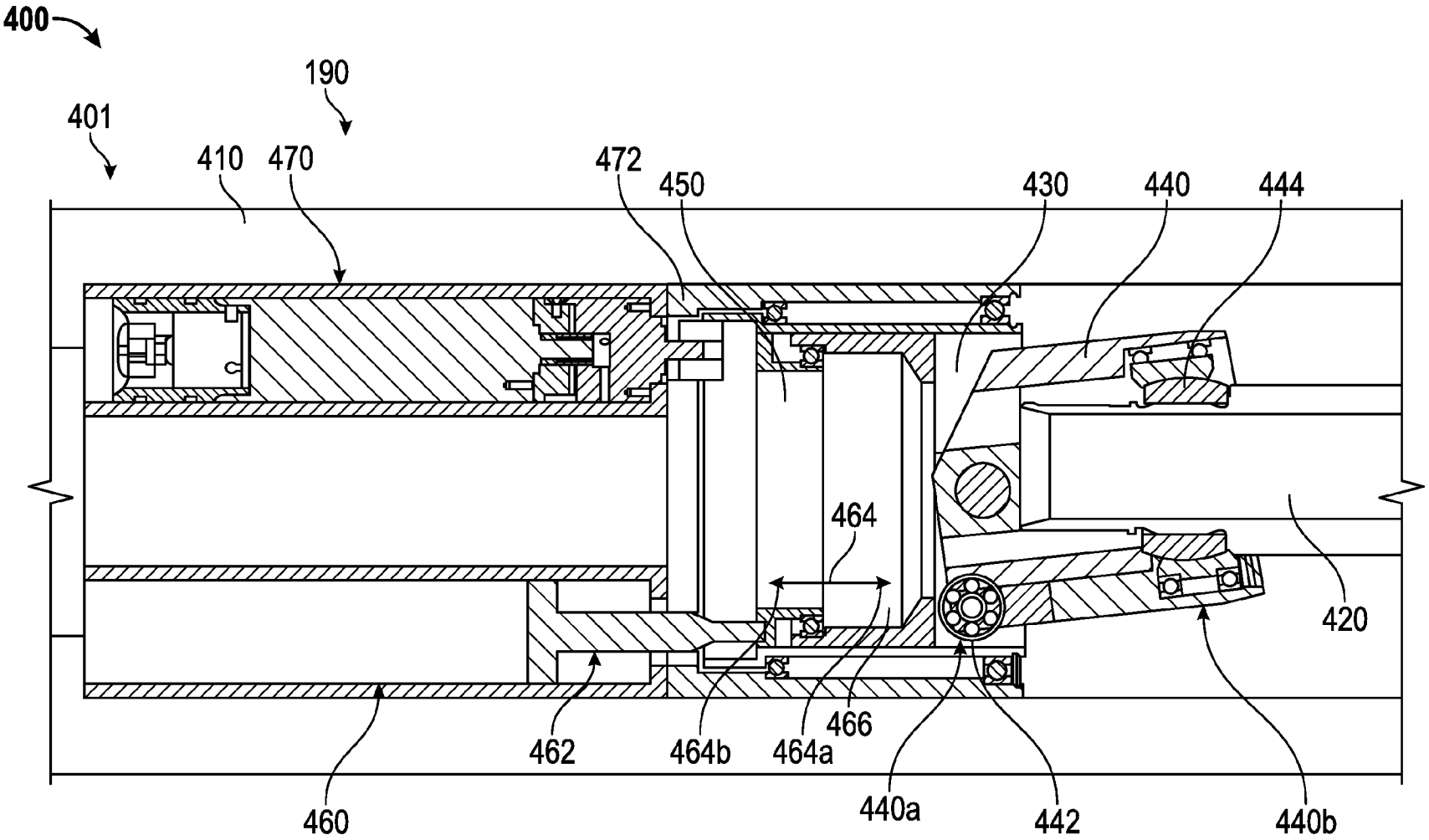
FIG. 4 shows yet another embodiment of a steering device that includes a double eccentric mechanism to tilt a drive shaft and control the steering direction.

FIG. 4 shows a steering device 400 in a drill collar 410 of a section 401 of a drilling assembly 190 according to another embodiment of the disclosure. The section 401 includes a drive shaft 420 that is coupled to a drill bit (not shown) for drilling a wellbore. The steering device 400 includes an orientation sleeve 430, a rocker arm 440 and an adjusting sleeve 450. The tilting action of the drive shaft 420 is provided and controlled by the orientation sleeve 430 and adjusting sleeve 450 with rocker arm 440. The drive shaft 420 rotates with the drill collar 410. The orientation sleeve 430 rotates counter to the rotation of the drill collar 410 at the same rotational speed as that of the drive shaft 420 to maintain the orientation sleeve 430 and rocker arm 440 geostationary. In one aspect, the steering device 400 includes linear drive 460 that includes a piston 462 that moves along axial directions shown by arrows 464. The piston 462 moves the adjusting sleeve 450 and a coupling member 466 to axially move the rocker arm 440. The rocker arm 440 includes a roller 442 at one end 440*a* proximate to the coupling member 466 and a slider or force application member 444 at its other end 440*b*. When the piston 462 moves to the right (along direction 464*a*), the adjusting sleeve 450 and the coupling member 466 move to the right, moving the rocker arm 440 to the right and radially outward, tilting the drive shaft 420 downward, as shown in FIG. 4. Moving the piston 462 to the left (along direction 464*b*), moves the rocker arm 440 left and downward, moving the drive shaft upward. The piston 462 may be moved by any suitable linear drive, including, but not limited to, an electric motor, hydraulic motor and a device driven by the drilling fluid.

Still referring to FIG. 4, the steering device 400 further includes a rotational drive 470 to rotate the orientation sleeve 430 and the rocker arm 440 counter to the rotation of the drive shaft 420 at the rotation speed of the drive shaft 420 to maintain the orientation sleeve geostationary. In the particular configuration of FIG. 4, an electric motor 470 is shown coupled to the adjusting sleeve 450 via a coupling member 472. The adjusting sleeve 450 in turn is connected to the orientation sleeve 430. When the motor 470 is rotated, it rotates the orientation sleeve 430 and the rocker arm 440 counter to the direction of rotation of the drill collar 410, thereby maintaining the orientation sleeve 430 and the rocker arm 440 geostationary. The operation of the motor and the hydraulic unit 460 may be controlled by a controller 170 in the tool 120 and/or controller 140 at the surface (FIG. 1). The counter rotation of the orientation sleeve and the axial movement may be accomplished by any other suitable rotational drive. Also, the axial movement of the rocker arm may be accomplished by any other suitable device, such as an electric motor, a spindle drive, etc. Thus, in the steering device 400, the orientation sleeve 430 provides the tilt direction of the drive shaft and the drilling direction of the tool 120. The adjusting sleeve 450 can be moved in its axial position. Position of the rocker arm 440 and thus the slider 444 placed on the drive shaft 420 is varied to control the tilt (angle) of the drive shaft 420.

Figure 5:
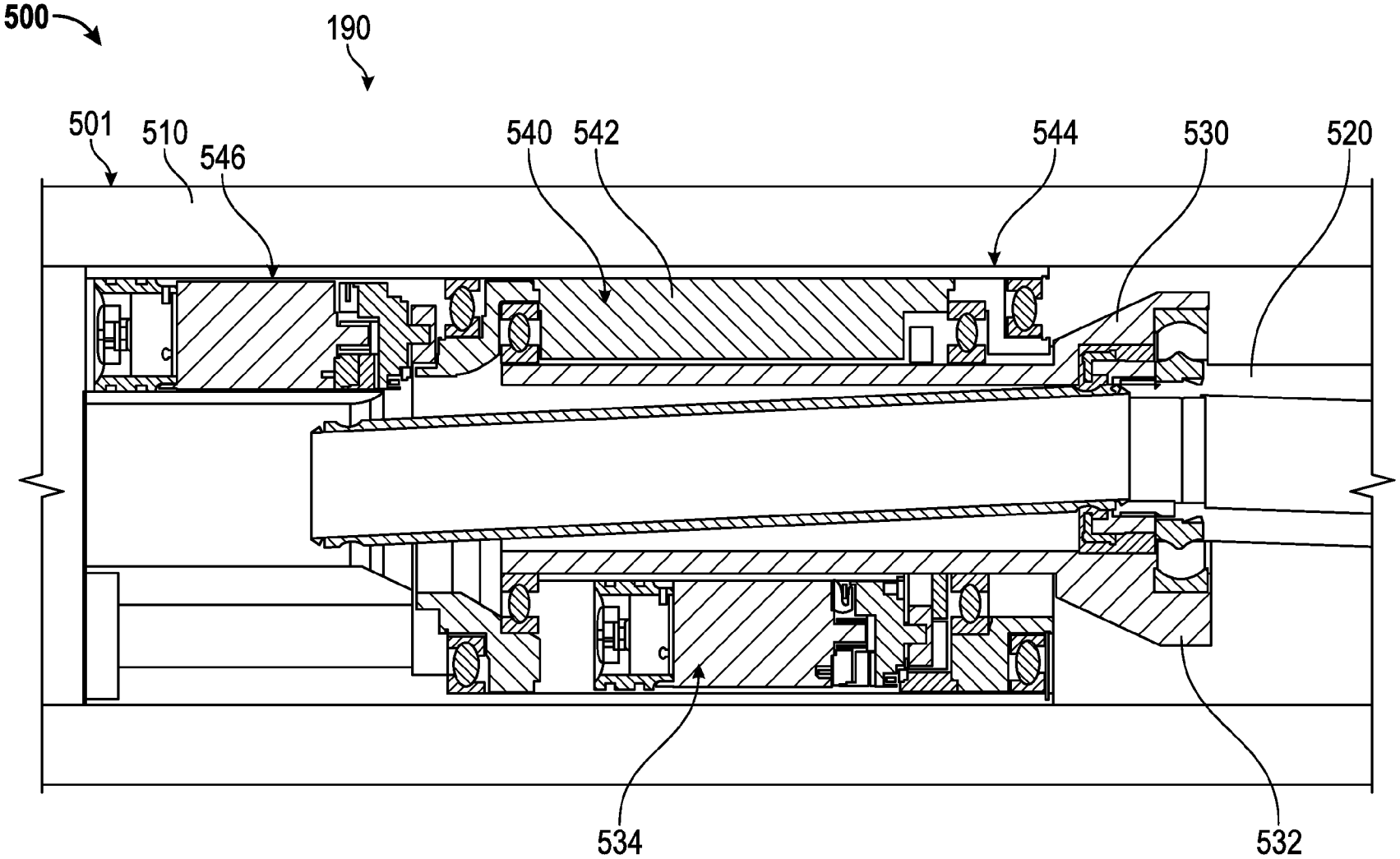
FIG. 5 shows yet another embodiment of a steering device that includes a rotating orientation sleeve to maintain and control the drilling direction and a rocker arm to provide the desired tilt to the drive shaft.

FIG. 5 shows another embodiment of a steering device 500 placed inside a drill collar 510 of section 501 of a drilling assembly 190. A drive shaft 520 connected to the drill collar 510 rotates when the drilling assembly 190 and the drill collar 510 rotate for drilling a wellbore. The steering device 500 utilized two eccentric devices, an inner eccentric device 530 and an outer eccentric device 540 to tilt and control the direction of the drive shaft 520 during drilling of a wellbore. The inner eccentric device includes a force application device 532 that is moved radially by a drive 534. The drive 534 may be any suitable drive, including, but not limited to, an electric motor, hydraulic motor, a motor driven by the drilling fluid. The outer eccentric device 540 includes an orientation sleeve 542 that rotates against the rotation of the drive shaft 520 at the same rotation speed as that of the drive shaft 520. The orientation sleeve 542 rotates the inner eccentric device 530 via a coupling 544 to maintain the inner eccentric device 530 geostationary relative to the axis of the drill collar. The counter rotation may be provided by any suitable drive, including, but not limited to an electric motor, hydraulic motor and a motor driven by the drilling fluid. In the particular configuration of FIG. 5, an electric motor 546 rotates the orientation member 542 via a coupling member 548 and thus the inner eccentric 530. The outer eccentric 540 provides the tilt direction of the drive shaft 520 and thus the drilling direction of the tool 120. In an aspect, the inner eccentric device 530 has a slightly increased eccentricity compared to the eccentricity of the orientation sleeve 542 that enables to tilt the drive shaft 520 a little bit beyond 0°, which improves the ability of the steering device 500 to steer straight ahead making small corrections without turning the inner eccentric sleeve 530 and outer eccentric sleeve 542 180° each time.

In reference to FIGS. 3-5, during drilling, the drive shaft rotates with the drill collar 220. A rotational drive in each such case rotates a force application device counter to the rotation of the drive shaft to maintain the force application device geostationary. A suitable force application mechanism is used to apply force on the force application device at a selected location of the drive shaft to tilt the drive shaft by a selected amount along a desired direction. To change the tilt, the force application mechanism alters the amount of the force. To alter the tilt direction, a positioning device moves the force application mechanism to a new position around the drive shaft to apply force on the drive shaft at a new location to cause the drive shaft to tilt toward the desired altered direction.

Figure 6:
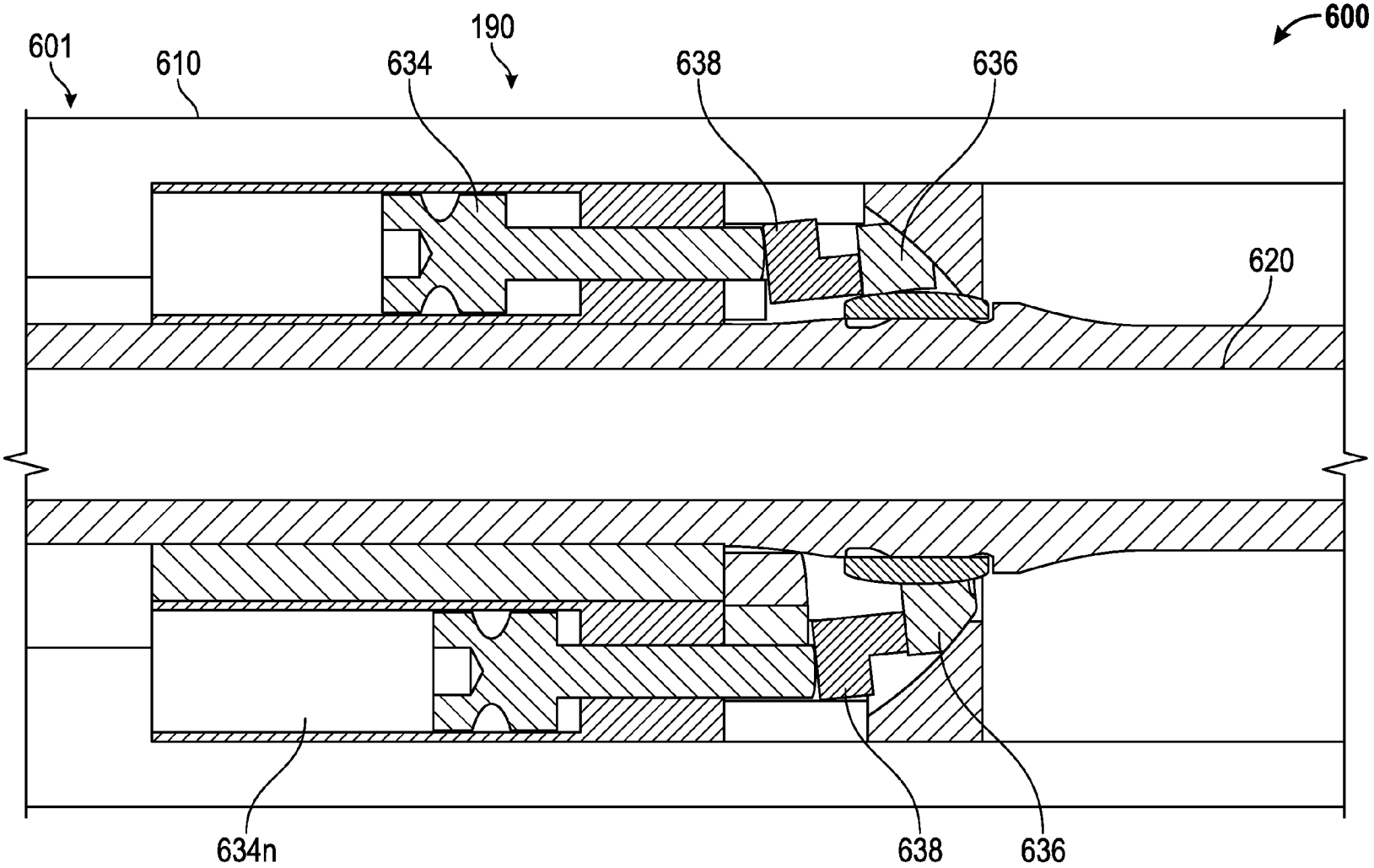
FIG. 6 shows yet another embodiment wherein a number of circumferentially disposed sequentially activated pistons control the drilling direction and the tilt of the drive shaft.

FIG. 6 shows a steering device 600 according to yet another embodiment of the disclosure. The steering device 600 is disposed in a drill collar 610 in a section 601 of a drilling assembly 190. The section 601 includes a drive shaft 620 coupled to a drill bit (not shown) for drilling a wellbore. The steering device 600 includes a number of force application devices 634*a* through 634*n* circumferentially placed around the drive shaft 620. The force application devices 634*a*-634*n* rotate with the drive shaft 620. Each such force application device is activated when such device is at a selected location relative to known point, such as high side of the drilling assembly. Locating the high side of a tool in the wellbore is known in the art. In one aspect, any number of force applications devices 634*a*-634*n* may be equally-spaced around the drive shaft 620. In one configuration, each force application device 634*a*-634*n* includes a piston that moves a force application member or force member to apply force on the drive shaft 620 to provide a selected amount of tilt to the drive shaft 620 along the selected direction. As shown in FIG. 6, force application device 630*a* includes a piston 634*a* that moves a swivel plate 636*a* radially perpendicular to the drive shaft 620 via a coupling member 638. In the particular configuration shown in FIG. 6, when piston 634*a* moves to the right, swivel plate 636 moves toward the drive shaft 620 to apply a selected force on the drive shaft 620. In one aspect, the swivel plate 632*a* may include a contoured face 636*c* that conforms to or substantially conforms to the drive shaft outer contour. The stroke of the piston 634*a* defines the amount of the force on the drill shaft 620 and thus the amount or angle of tilt. Similarly, each of the other pistons, such as piston 634*n* applies force on the drive shaft 620 via a swivel 636*n* to provide the tilt. The pistons 634*a*-634*n* may be actuated by any drive system, including, but not limited to, an electrical motor, a hydraulic motor and a motor driven by the drilling fluid. During drilling of a wellbore, the drive shaft 620 rotates and the pistons are dynamically actuated to provide a selected amount of tilt along a selected direction. Thus, in the steering device configuration shown in FIG. 6, drive shaft 620 is jointed to the housing 601 and rotates at the same rotational speed as the drill collar 610. The tilt direction of the drive shaft 620 is held geostationary and the tilting or bending of the drive shaft 620 is generated by dynamic actuated pistons.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. An apparatus for drilling a wellbore, comprising:

a drilling assembly having a drive shaft that rotates with the drilling assembly during drilling of the wellbore, the drive shaft being adapted to rotate a drill bit; and a steering device that includes a force application device that tilts the drive shaft and a rotational drive that maintains the force application device geostationary, wherein the rotational drive includes a rotatable member coupled to the force application device; and a device to rotate the rotatable member.

2. The apparatus of claim 1, wherein the force application device includes a linear drive that moves a force member radially to apply a selected force on the drive shaft to tilt the drive shaft by a selected angle.

3. The apparatus of claim 2, wherein the linear drive is selected from a group consisting of: an electric motor that drives a member coupled to the force member; an oil hydraulic device that drives a member coupled to the force member; and a motor driven by a drilling fluid that drives a member coupled to the force member.

4. The apparatus of claim 3, wherein the force member is selected from a group consisting of: a first member that slides along an angle to move a second member radially to apply the force on the drive shaft; and a rocker arm that moves axially and radially to apply force on the drive shaft.

5. The apparatus of claim 1, wherein the device that rotates the rotatable member includes a motor that rotates the force application device within the drilling assembly.

6. The apparatus of claim 1, wherein the force application device includes a plurality of force devices, each configured to selectively apply force on the driveshaft when the drive shaft is rotating.

7. The apparatus of claim 6, wherein each force device includes a piston that moves axially to apply force on the drive shaft.

8. The apparatus of claim 1 further comprising a logging-while-drilling tool for estimating a formation parameter.

9. The apparatus of claim 1, wherein the drive that rotates the rotatable member is selected from a group consisting of: an electric motor; a motor driven by oil hydraulics; and a motor driven by a drilling fluid.

10. A drilling system for drilling a wellbore, comprising:

a drill string having a drilling assembly:

a drive shaft coupled to a drill, wherein the drive shaft rotates with the drilling assembly during drilling of the wellbore;

a force application device around the drive shaft that applies a selected force on the drive shaft to tilt the drive shaft along a selected direction during drilling of the wellbore; and a rotational drive that maintains the force application device geostationary during drilling of the wellbore, wherein the rotational drive includes a rotatable member coupled to the force application device; and a device to rotate the rotatable member.

11. The drilling system of claim 10, wherein the force application device includes a linear drive that moves a force member radially to apply the force on the drive shaft.

12. A method of drilling a wellbore, comprising:

conveying a drilling assembly in the wellbore that includes a drive shaft coupled to a drill bit, a steering device that includes a force application device around the drive shaft to apply force on the drive shaft to tilt the drive shaft;

rotating the drilling assembly to rotate the drive shaft to drill the wellbore;

maintaining the force application device geostationary;

applying force radially on the drive shaft by the force application device to tilt the drive shaft by a selected angle along a selected direction to drill the wellbore along a selected direction.

13. The method of claim 12, wherein applying the force radially on the drive shaft comprises moving a member linearly to drive a force member radially to apply the force radially on the drive shaft.

14. The method of claim 13 further comprising moving the member linearly comprises using a linear drive to move the member linearly, wherein the linear drive is selected from a group consisting of: an electric motor that drives a member coupled to the force member; an oil hydraulic device that drives a member coupled to the force member; and a motor driven by a drilling fluid that drives a member coupled to the force member.

15. The method of claim 13, wherein the force member is selected from a group consisting of: a first member that slides along a an angle to move a second member radially to apply the force on the drive shaft; and a rocker arm that moves axially and radially to apply force on the drive shaft.

16. The method of claim 12, wherein maintaining the force application device geostationary comprises rotating the force application device counter to the rotation of the drive shaft at rotational speed of the drive shaft.

17. The method of claim 16 further comprising rotating a rotational member coupled to the force application device around the drive shaft at the rotational speed of the drive shaft.

18. The method of claim 12, wherein applying the force comprises using a plurality of force devices placed circumferentially around the drive shaft.

19. The method of claim 18 further comprising using a piston axially to move an associated member radially as each force device in the plurality of force devices.

20. The method of claim 12 further comprising controlling the tilt to control the direction of drilling the wellbore.

21. The method of claim 12, further comprising estimating a downhole parameter while drilling the wellbore and controlling drilling direction of the wellbore in response to the estimated downhole parameter.

22. The method of claim 12 further comprising altering radial force on the force application device to alter tilt of the drive shaft and repositioning the force application device around the drive shaft to alter the selected direction during drilling of the wellbore.

23. An apparatus for drilling a wellbore, comprising:

a drilling assembly having a drive shaft that rotates with the drilling assembly during drilling of the wellbore; and a steering device that includes:

a force member, a swivel plate coupled to the force member, and a plurality of force application devices around the drive shaft that rotate with the drive shaft and sequentially apply an axial force on the swivel plate to produce a radial force on the force member to tilt the drive shaft along a selected direction.

24. The apparatus of claim 23 further comprising a controller that activates each force application device when such force application device arrives at a selected location.

* * * * *